United States Patent [19]

Reimer

[11] Patent Number: 4,591,217

[45] **Date of Patent: * May 27, 1986**

[54] LOW INSERTION FORCE CONNECTION ARRANGEMENT

[75] Inventor: William A. Reimer, Wheaton, Ill.

[73] Assignee: GTE Communication Systems Corporation, Northlake, Ill.

[ * ] Notice: The portion of the term of this patent subsequent to Mar. 12, 2002 has been disclaimed.

[21] Appl. No.: 680,218

[22] Filed: Dec. 10, 1984

Related U.S. Application Data

[63] Continuation-in-part of Ser. No. 527,638, Aug. 29, 1983, Pat. No. 4,505,527.

[51] Int. Cl.[4] ..... H01R 9/09

[52] U.S. Cl. ..... 339/17 LM; 339/75 MP; 339/176 MP; 339/205

[58] Field of Search ..... 339/17 LM, 17 L, 74 R, 339/75 MP, 176 MP, 204, 205

[56] References Cited

U.S. PATENT DOCUMENTS

| | | | |
|---|---|---|---|
| 3,611,259 | 10/1971 | Palecek | 339/74 R |
| 4,076,362 | 2/1978 | Ichimura | 339/75 MP |
| 4,080,027 | 3/1978 | Benasutti | 339/75 MP |
| 4,176,900 | 12/1979 | Hines et al. | 339/176 MP |
| 4,189,200 | 2/1980 | Yeager et al. | 339/75 MP |
| 4,230,388 | 10/1980 | Thierry et al. | 339/74 R |
| 4,266,839 | 5/1981 | Aikens | 339/75 MP |
| 4,274,699 | 6/1981 | Keim | 339/176 MP |
| 4,275,944 | 6/1981 | Sochor | 339/74 R |
| 4,327,955 | 5/1982 | Minter | 339/75 MP |
| 4,400,049 | 8/1983 | Schuck | 339/176 MP |
| 4,504,101 | 3/1985 | Reimer | 339/176 MP |
| 4,505,527 | 3/1985 | Reimer | 339/176 MP |
| 4,505,528 | 3/1985 | Reimer | 339/176 MP |

*Primary Examiner*—John McQuade

*Attorney, Agent, or Firm*—Robert J. Black; Gregory G. Hendricks

[57] ABSTRACT

A low insertion force connection arrangement for establishing a connection between at least two printed wiring boards each of the type including a plurality of printed wiring board terminals. The connection arrangement includes a plurality of connection springs each including an actuator engaging area located centrally on a side of the spring facing the printed wiring boards and between two pivot points. The pivot points are located on a side of the connection spring facing away from the printed wiring boards and between two contacts. The contacts are located at opposite ends of the connection spring, facing, and in alignment with corresponding ones of the printed wiring board terminals. A connector body is provided including a plurality of grooves each adapted to receive and retain one of the printed wiring boards in alignment with the other, and a cavity, including molded-in fulcrums opposite the spring's pivot points, in which the connection spring is retained by means of spring fingers acting against recesses formed in the cavity walls. An actuator is rotationally positioned to engage the actuator engaging area to simultaneously pivot, or alternatively to sequentially pivot the connection spring about its pivot points and against the fulcrums to contact and wipe the spring contacts across the printed wiring board terminals.

7 Claims, 6 Drawing Figures

LOW INSERTION FORCE CONNECTION ARRANGEMENT

CROSS-REFERENCES TO RELATED APPLICATIONS

This is a continuation in part of application Ser. No. 527,638, filed Aug. 29, 1983 and issued Mar. 19, 1985 as U.S. Pat. No. 4,505,527.

Related, commonly assigned, co-pending continuation in part applications include "Low Insertion Force Connection Arrangement," Ser. No. 679,794, "Low Insertion Force Connection Arrangement," Ser. No. 679,795, and "Low Insertion Force Connection Arrangement," Ser. No. 679,793, all filed concurrently herewith and invented by the same inventor.

Related, commonly assigned, co-pending applications include "Printed Wiring Board File," Ser. No. 527,635, issued July 30, 1985 as U.S. Pat. No. 4,532,576; "Double File Printed Wiring Board Module," Ser. No. 527,634, issued Aug. 27, 1985 as U.S. Pat. No. 4,538,209; "Printed Wiring Board Interconnect Arrangement," Ser. No. 527,636, issued Feb. 12, 1985 as U.S. Pat. No. 4,498,717; "Low Insertion Force Connection Arrangement," Ser. No. 527,637, issued Mar. 12, 1985 as U.S. Pat. No. 4,504,101; and "Low Insertion Force Connection Arrangement," Ser. No. 527,639, issued Mar. 19, 1985 as U.S. Pat. No. 4,505,528; all filed Aug. 29, 1983 and invented by the same inventor.

BACKGROUND OF THE INVENTION

The present invention relates to arrangements for establishing connection to printed wiring boards and more particularly to a low insertion force arrangement for interconnecting two or more printed wiring boards.

Printed wiring board interconnect arrangements are very well known to those skilled in the art. One type, described in U.S. Pat. No. 3,771,100 issued on Nov. 6, 1973 to Norman Leonard Reed. This type includes a contact which is integrally formed by folding a sheet metal blank. It comprises a pair of elongated spring arms supported longitudinally and spaced apart at one of their ends by an elongated body portion. The arms extend in opposite directions away from their supporting ends and each arm extends towards the supporting end of the other arm so that they overlap or cross. Contact portions are located at the free ends of each arm adjacent to the supported end of the other arm and they face away the spring body. Each contact is mounted in a slot within a carrier block of insulating material by latch arms formed on the body portion which project away from the spring arms and engage a shoulder formed in the carrier block.

Another arrangement for interconnecting printed wiring boards is described in U.S. Pat. No. 3,871,736 which was issued on Mar. 18, 1975 to Carter, et al. This patent teaches an electrical connector mounted in a housing to electrically and mechanically interconnect a pair of parallel adjacent printed wiring boards and to connect the printed wiring boards to an adjacent terminal. Pairs of resilient, parallel, spaced apart legs extend from a connector body and are adapted to resiliently grip the printed wiring boards therebetween.

U.S. Pat. No. 4,255,003, which was issued on Mar. 10, 1981 to William E. Berg, teaches an electrical connector for interconnecting conductive paths of two circuit elements by means of the following: a contact member including a concave portion interposed between two convex portions; a resilient member conforming to the contact member in part; and a connector body, so formed that when the body is forced against the circuit elements, the resilient member forces the contact member into engagement with the circuit element conductive paths.

Devices permitting connection to printed wiring boards are also well known in the art. In this regard, zero insertion force, edge board connectors have been disclosed in U.S. Pat. No. 4,189,200 issued Feb. 19, 1980 to Yeager, et al., and U.S. Pat. No. 4,159,861 issued July 3, 1979 to Anhalt. These connectors include cantilevered contacts biased toward the printed wiring board and positioned out of engagement with the board for insertion purposes. Connectors including cantilevered contacts biased against the printed wiring board and temporarily retracted from contact with the board directly by means of an actuator are disclosed in U.S. Pat. No. 3,793,609 issued Feb. 19, 1974 to McIver, and U.S. Pat. No. 3,848,221 issued Nov. 12, 1974 to Lee. Finally, a low insertion force connector including cantilevered contacts biased out of engagement with the printed wiring board and positioned into engagement with the printed wiring board through the use of actuators is taught in U.S. Pat. No. 4,176,900 issued Dec. 4, 1979 to Heinz, et al.

The art cited is seen to teach various arrangements of cantilevered or resiliently biased contact springs for connecting to or interconnecting printed wiring boards.

SUMMARY OF THE INVENTION

The present invention provides a low insertion force arrangement for establishing a connection between at least two printed wiring boards. Each board is of the type that includes a plurality of printed wiring board terminals. The connection arrangement includes the following: a plurality of connection springs each having first and second contacts, each contact engageably positioned relative to a corresponding one of the terminals; first and second pivot points; and an actuator engaging area. First and second fulcrums are included in the arrangement and are positioned to engage the spring at the first and second pivot points, respectively. An actuator is also included and it is located proximate to the spring at the actuator engaging area. The actuator may be rotationally positioned in a first position relative to the spring to simultaneously pivot, or in the alternative to sequentially pivot the springs and engage the springs contacts with their respective terminals. The actuator is rotationally positioned in a second position relative to the spring to simultaneously, or in the alternative to sequentially pivot the springs and disengage the spring's contacts from their respective terminals.

BRIEF DESCRIPTION OF THE DRAWING

Various features and advantages of a zero insertion force connection arrangement in accordance with the present invention will be apparent from the following description taken in conjunction with the accompanying drawing in which.

DETAILED DESCRIPTION OF THE INVENTION

Figure 1:
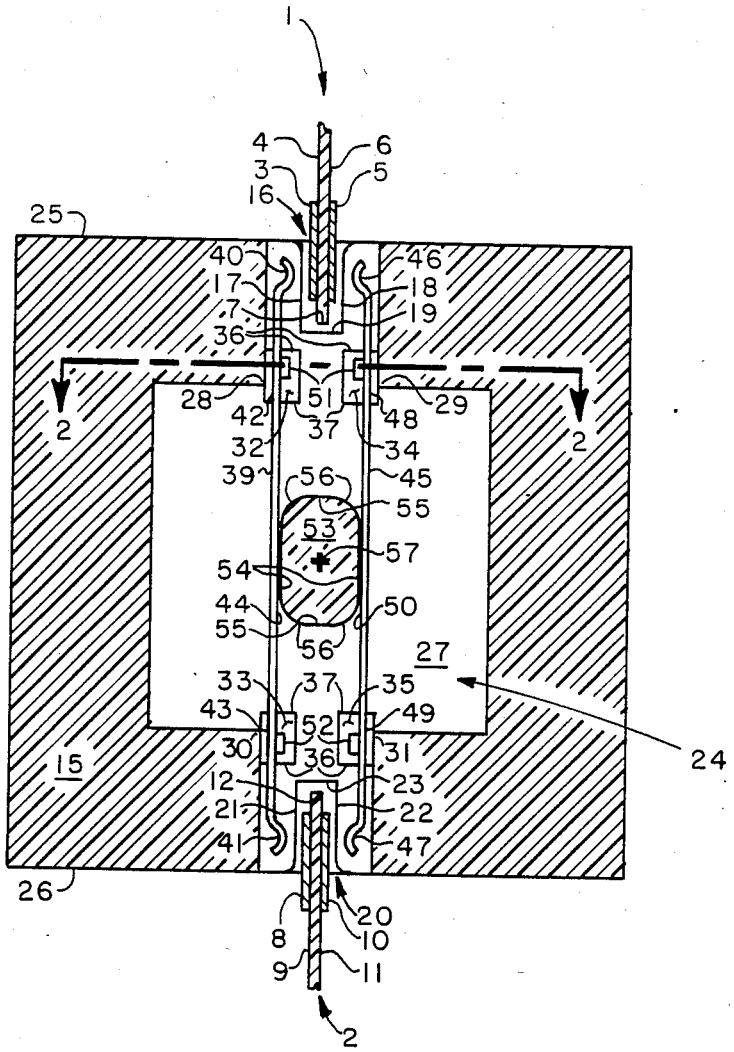
FIG. 1 is a cross sectional view of a zero insertion force connection arrangement for two printed wiring boards in accordance with the present invention.

Referring now to FIG. 1 there is shown an arrangement for connecting a first printed wiring board 1 to a second printed wiring board 2. The first printed wiring board 1 includes a first plurality of terminals 3 located on a first side 4 and a second plurality of terminals 5 located on a second side 6. The first terminals 3 and the second terminals 5 are located near an edge 7 of the first printed wiring board 1. Similarly, the second printed wiring board 2 includes a first plurality of terminals 8 located on a first surface 9 and a second plurality of terminals 10 located on a second surface 11. The first plurality of terminals 8 and the second plurality of terminals 10 are located near an edge 12 of the second printed wiring board.

A connector body 15 is provided with a first groove 16 including a first wall 17, a second wall 18, and a floor 19. The connector body 15 also includes a second groove 20 including a first wall 21, a second wall 22, and a floor 23.

Figure 2:
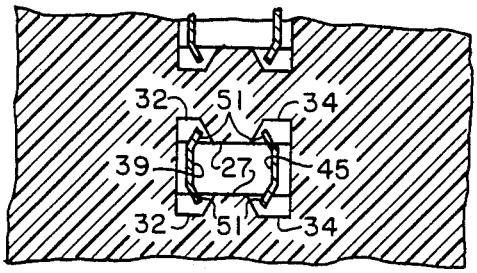
FIG. 2 is a sectional view taken along line 2—2 in FIG. 1.

A plurality of spring receiving cavities 24 are formed in the connector body 15 in alignment with corresponding groups of one of each of the terminals 3, 5, 8, and 10. The cavities 24 extend between a first side 25 and a second side 26 of the connector body 15 and include a pair of parallel opposite walls 27 (such walls are shown in FIG. 2). A first fulcrum 28 and a second fulcrum 29 are each formed in each of the spring receiving cavities 24, between the opposite walls 27, near the first side 25 of the connector body 15, and near the first side 4 and the second side 6 of the first printed wiring board 1, respectively. Similarly, a third fulcrum 30 and a fourth fulcrum 31 are formed in each of the spring cavities 24, between the opposite walls 27, near a second side 26 of the connector body 15 and near the first side 9 and the second side 11 of the second printed wiring board 2, respectively.

Referring to FIG. 2, a first pair of recesses 32 and a second pair of recesses 33 (shown in FIG. 1) are formed in the walls 27 of each of the spring receiving cavities 24 near the first sides 4 and 9 of the printed wiring boards 1 and 2, respectively. Similarly, a third pair 34 and a fourth pair 35 (shown in FIG. 1) of recesses are formed in the walls 27 of each of the spring receiving cavities 24 near the second sides 6 and 11 of the printed wiring boards 1 and 2, respectively. Referring again to FIG. 1, each of the recesses 32 through 35 is elongated and includes an outer edge 36 and an inner edge 37. Each of the spring receiving cavities 24 intersects the first printed wiring board receiving groove 16 and the second printed wiring board receiving groove 20.

Each of the spring receiving cavities 24 includes an elongated first spring 39 positioned therein. Each of the first springs 39 includes a first contact 40, a second contact 41 positioned at opposite ends thereof. The first contact 40 of each of the first springs 39 is positioned proximate to a corresponding one of the first contacts 3 of the first printed wiring board 1 and the second contact 41 of each of the first springs 39 is positioned proximate to a corresponding one of the first contacts 8 of the second printed wiring board 2. Each of the first springs 39 includes a first pivot point 42 and a second pivot point 43 positioned on a side of the spring facing away from the printed wiring boards 1 and 2 and located between the first contact 40 and the second contact 41. An actuator engaging area 44 is positioned on a side of each of the first springs 39 facing the printed wiring boards 1 and 2 and located between the pivot points 42 and 43. Similarly, each of the spring receiving cavities 24 includes a second spring 45 including a first contact 46 positioned proximate to a corresponding one of the second terminals 5 of first printed wiring board 1 and a second contact 47 positioned proximate to a corresponding one of the second terminals 10 of the printed wiring board 2. Each of the second springs 45 includes a first pivot point 48 and a second pivot point 49 positioned on a side of the spring facing away from the printed wiring boards 1 and 2 and located between the first contact 46 and the second contact 47. An actuator engaging area 50 is positioned on a surface of the second spring 45 facing towards the printed wiring boards 1 and 2 and located between the pivot points 48 and 49. The pivot points 42, 43, 48, and 49 are positioned to engage the fulcrums 28, 30, 29, and 31, respectively, when the springs 39 and 45 are operated as described below.

Referring to FIG. 2, each of the first springs 39 and the second springs 45 includes a first pair of retaining fingers 51 and a second pair of retaining fingers 52 (see FIG. 1) to retain the springs within their respective spring receiving cavities 24 while permitting spring movement about the pivot points 42, 43, 48, and 49. Referring again to FIG. 1, the first pair of retaining fingers 51 are attached to each of the first springs 39 near the first pivot point 42 and to each of the second springs 45 near the first pivot point 48. Similarly, the second pair of retaining fingers 52 are attached to each of the first springs 39 near each of the second pivot points 43 and to each of the second springs 45 near each of the second pivot points 49.

An actuator 53 is included between each corresponding pair of the first actuator engaging areas 44 and the second actuator engaging area 50 and includes a pair of low points 54 and a pair of high points 55 connected by a plurality of cam surfaces 56. Each of the actuators 53 is arranged to pivot about a pivot point 57.

Referring to FIG. 1, the connector of the present invention is operated by rotating the actuator 53 to place the low points 54 in contact with the actuator engaging areas 44 and 50. In this position, the first spring 39 and the second spring 45 are in their unactuated positions. The first contacts 40 and 46 are out of engagement with the first contacts 3 and the second contacts 5 of the first printed wiring board 1. Similarly, the second contacts 41 and 47 are out of contact with the first terminals 8 and the second terminals 10 of the printed wiring board 2. The first spring 39 is held in place while unactuated by the first retaining fingers 51 and the second retaining fingers 52 of the spring acting against the outer edges 36 of the first recesses 32 and the second recesses 33, respectively. Similarly, the second spring 45 is held in place while unactuated by the first retaining fingers 51 and the second retaining fingers 52 of the spring acting against the outer edges 36 of the third recess 34 and the fourth recess 35, respectively.

The printed wiring boards 1 and 2 may now be inserted into the first groove 16 and second groove 20 with low insertion force to the point where edges 7 and 12 abut groove floors 19 and 23, respectively. Once inserted, the first terminal 3 of the first printed wiring board 1 may be connected to the first terminal 8 of the second printed wiring board 2 and the second terminal 5 of the first printed wiring board 1 may be connected to the second terminal 10 of the second printed wiring board 2 by rotating the actuator 35. In this regard, the actuator 53 is rotated 90 degrees in either direction to place the high points 55 in contact with the actuator engaging areas 44 and 50, thus deflecting the first and second springs 39 and 45.

As the springs 39 and 45 are deflected, the actuator engaging areas 44 and 50 move away from each other causing the springs to pivot about their first pivot points 42 and 48 acting against the fulcrums 28 and 29, respectively, and their second pivot points 43 and 49 acting against the fulcrums 30 and 31, respectively, thus moving the first contacts 40 and 46 into engagement with the terminals 3 and 5 of the first printed wiring board 1 and the second contacts 41 and 47 into engagement with the terminals 8 and 10 of the second printed wiring board 2. Following engagement of the contacts 40, 46, 41, and 47 with the terminals 3, 5, 8, and 10, further movement of the actuator engaging areas 44 and 50 away from each other causes spring segments between the actuator engaging areas and their contacts to deflect and wipe the contacts against their respective terminals. Wiping action of the first contacts 40 and 46 with respect to wiping action of the second contacts 41 and 47 of the first spring 39 and the second spring 45, respectively, is controlled by action of the first fingers 51 of the first and second springs 39 and 45 against the inner edges 37 of the first and third recesses 32 and 34, respectively, and action of the second fingers 52 of the first and second springs 39 and 45 against the inner edges 37 of the second and the fourth recesses 33 and 35.

While but a single actuator has been shown and described, it will be appreciated in a connector having many actuators and many connection springs, that the actuators associated with each set of connection springs may be positioned to simultaneously operate the springs, orthe actuators may be offset or separately operatable with respect to each other to sequentially operate each set of connection springs. In this regard, FIGS. 4 through 6 show an alternate method of positioning the actuators of adjacent spring pairs to achieve sequential spring operation.

Figure 4:
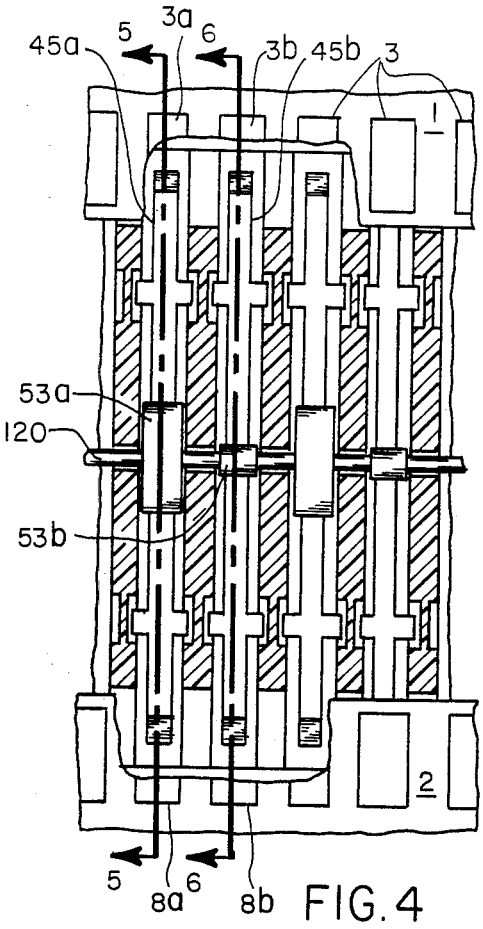
FIG. 4 is a side sectional view of the connector arrangement of the present invention including an alternate sequential rotary actuator taken along the line 4—4 in FIG. 5.
Figure 5:
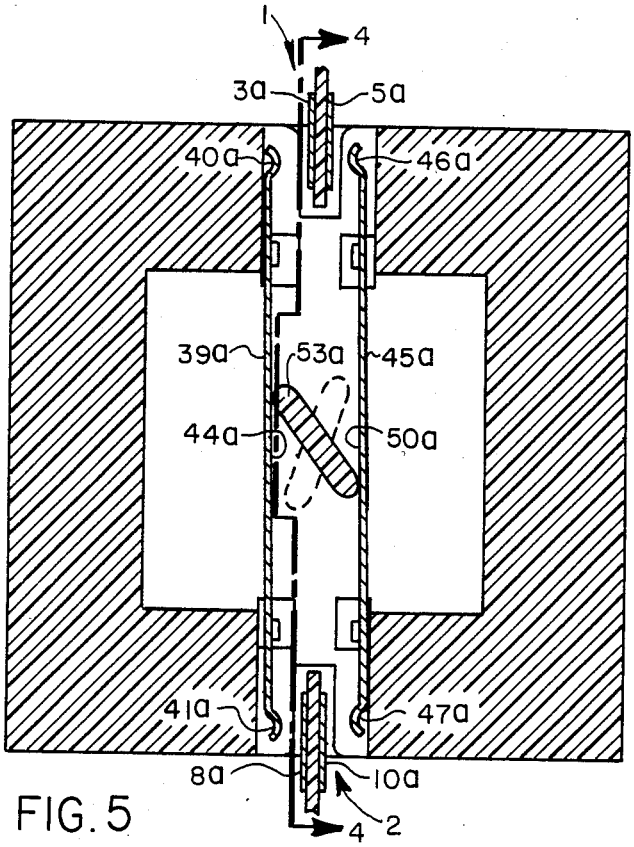
FIG. 5 is a sectional view taken along the line 5—5 in FIG. 4.

Referring now to FIGS. 4 and 5, there is shown a first connection spring **39*a* and a second connection spring 45*a* each include an actuator engaging area 44*a* and 50*a* on their facing surfaces, a first contact 40*a* and 46*a* at an upper end thereof, and a second contact 41*a* and 47*a* at a lower end thereof, all respectively. An actuator 53*a* is positioned to engage the actuator engaging areas 44*a* and 50*a* to operate the connection springs. The actuator 53*a* may be positioned in an unoperated position (shown in phantom line in FIG. 5**).

Figure 6:
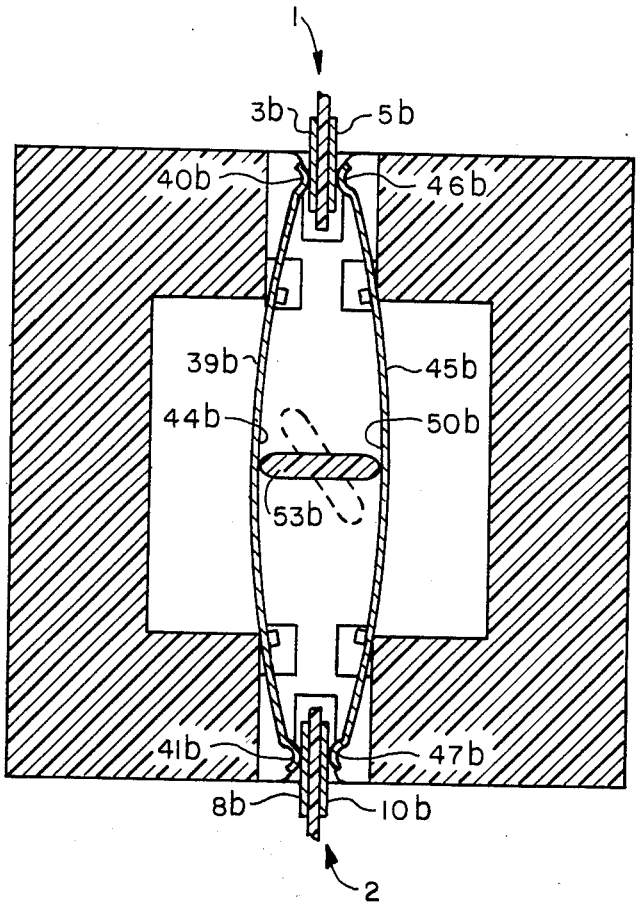
FIG. 6 is a sectional view taken along the line 6—6 in FIG. 4.

Similarly, and referring to FIGS. 4 and 6, there is shown a first connection spring **39*b* and a second connection spring 45*b* of an adjacent connection spring pair. The connection springs 39*b* and 45*b* each include an actuator engaging areas 44*b* and 50*b* on their facing surfaces, a first contact 40*b* and 46*b* at an upper end thereof and a second contact 41*b* and 47*b* at a lower end thereof, all respectively. An actuator 53*b* is positioned to engage the actuator engaging areas 44*b* and 50*b* to operate the connection springs. The actuator 53*b* may be positioned in in an unoperated position (shown in phantom line in FIG. 6**).

Referring now to FIGS. 5 and 6, the "b" connection spring pair including first connection spring **39*b* and second connection spring 45*b* may be sequentially operated before the "a" connection spring pair including first connection spring 39*a* and second connection spring 45*a* by rotating the actuators 53*a* and 53*b* 90 degrees in a counterclockwise direction from their unoperated (phantom line) positions. The actuators 53*a* and 53*b* may be positioned relative to each other and their rotation facilitated by connecting them together. In this regard, they may be connected by a solid shaft 120 (shown in FIG. 4**).

Upon partial rotation of the actuators **53*a* and 53*b* in the counterclockwise direcion, the actuator 53*b* will engage the actuator engaging areas 44*b* and 50*b* of the first connection spring 39*b* and the second connection spring 45*b*, respectively. The actuator 53*a*, because of its angular position relative to the actuator 53*b*, will not engage either of its associated connection springs. Upon continued rotation of the actuators 53*a* and 53*b* the actuator 53*b* will deflect the first connection spring 39*b* and the second connection spring 45*b* in an outward direction, thereby pivoting their associated contacts 40*b*, 46*b*, 41*b* and 47*b* into engagement with the printed wiring board terminals 3*b*, 5*b*, 8*b* and 10*b*, respectively (shown in FIG. 6). At the same time, the actuator 53*a* will engage the actuator engaging areas 44*a* and 50*a* of the first connection spring 39*a* and the second connection spring 45*a*, respectively (shown in FIG. 5**). At this time deflection of the "a" connection springs will not occur.

Upon further continued rotation of the actuators **53*a* and 53*b*, the actuator 53*b* will partially release the associated connection springs 39*b* and 45*b* but not enough to permit their associated contacts to disengage from the terminals of the printed wiring boards 1 and 2. At the same time the actuator 53*a* will deflect the first connection spring 39*a* and the second connection spring 45*a*, thereby pivoting their associated contacts 40*a*, 46*a*, 41*a* and 47*a* into engagement with the printed wiring board terminals 3*a*, 5*a*, 8*a*, and 10*a*, respectively. At this point the forces of the connection springs 39*b* and 45*b* tending to rotate the actuator 53*b* in a counterclockwise direction will be balanced by the forces of the connection springs 39*a* and 45*a*, acting on the actuator 53*a* and tending to rotate the actuator in a clockwise direction. The forces on the actuator 53*a* in a clockwise direction and 53*b*** in a counterclockwise direction, thereby establish an actuated equilibrium point for the connection springs of the present invention.

The actuators may be rotated in a clockwise direction back to their unoperated positions (shown in phantom line in FIGS. 5 and 6) to release the connection springs **39*a*, 45*a*, 39*b* and 45*b*, thereby permitting their associated contacts to disengage the associated terminals printed wiring boards 1 and 2** and thereby completing a sequenced release of the contacts.

Figure 3:
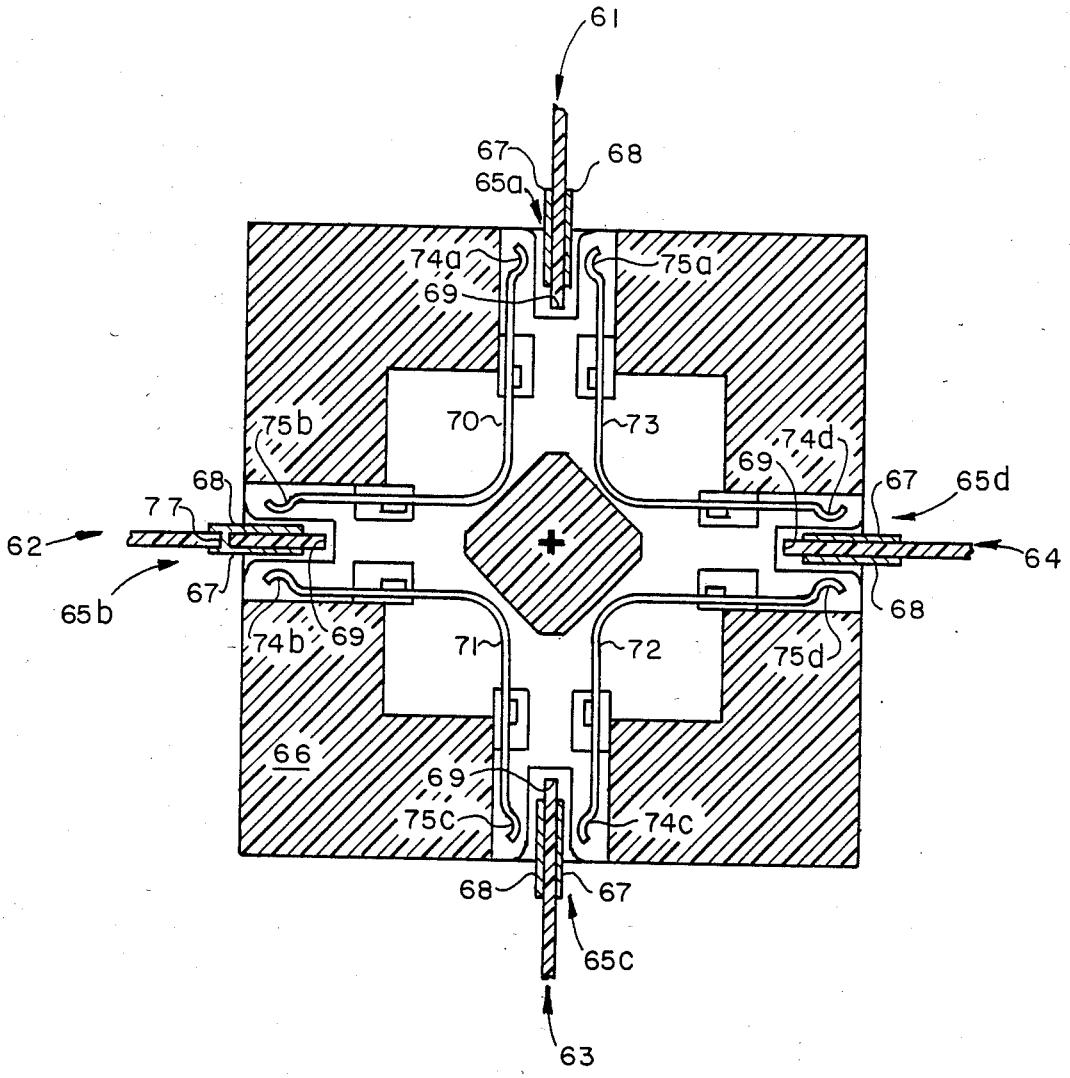
FIG. 3 is a cross sectional view of a zero insertion force connection arrangement for four printed wiring boards in accordance with the present invention.

It will also be appreciated that while the preferred embodiment described above connects two printed wiring boards together, more than two printed wiring boards may be connected in a similar manner. Referring to FIG. 3, there is shown an arrangement for connecting four printed wiring boards. In this regard, a first printed wiring board 61, a second printed wiring board 62, a third printed wiring board 63, and a fourth printed wiring board 64 are shown positioned within a plurality of grooves 65*a–d* of connector body 66. Each of the printed wiring boards 61 through 64 includes a first set of terminals 67 and a second set of terminals 68 positioned near an edge 69 of the printed wiring board. Four pluralities of connection springs 70–73 are located between facing surfaces of adjacent printed wiring boards and positioned to engage corresponding terminals via first contacts 74*a–d* and the second contacts 75*a–d*, respectively. In this regard, the first terminal 67 of first printed wiring board 61 is connected to the second terminal 68 of the second printed wiring board 62 by the connection spring 70, and the contacts 74*a* and 75*b* thereof. Similarly, the first contact 67 of the second printed wiring board 62 may be connected to the second contact 68 of the third printed wiring board 63 by the connection spring 71 and the contacts 74*b* and 75*c* thereof. In like manner, the contacts of the printed wiring board 64 may be connected to corresponding contacts of the printed wiring boards 61 and 63.

Non-adjacent printed wiring boards may be connected by routing connections through intermediate printed wiring boards. In this regard, a connection may be formed between the first terminal 67 of the first printed wiring board 61 and the second terminal 68 of the third printed wiring board 63 by including a connection 77 between the first terminal 67 and the second terminal 68 of the second printed wiring board 62. The connection thus established would include the contact 74*a*, the spring 70, the contact 75*b*, the terminal 68 of the printed wiring board 62, the connection 77, the terminal 67 of the printed wiring board 62, the contact 74*b*, the spring 71, and the contact 75*c*.

Additional embodiments of the present invention may be realized by combining the details of the first embodiment with the details of the second embodiment. In this regard, a connector may be constructed in a third embodiment (not shown) including a rear connector portion according to the embodiment of FIGS. 1 and 2 and a front portion according to the embodiment of FIG. 3. Alternatively, a connector may be constructed in a fourth embodiment (also not shown) including a left side portion according to the embodiment of FIGS. 1 and 2 and a right side portion according to the embodiment of FIG. 3. Such fourth embodiment would yield a three card interconnect connector.

It will now be apparent that a low insertion force arrangement for connecting a plurality of printed wiring boards has been described hereinabove which provides improvements over prior art assemblies. The arrangement may be used to interconnect two printed wiring boards according to the embodiment shown in FIGS. 1 and 2 or the invention may be used to interconnect more than two printed wiring boards as shown in the embodiment of FIG. 3. Two additional embodiments of the present invention have been mentioned which result from the combination of features of the first two embodiments in different manners. Alternate actuator embodiments are disclosed which are arranged to simultaneously, or in the alternative to sequentially operate the connection springs of the present invention.

While but four embodiments of the present invention have been disclosed, it will be appreciated by those skilled in the art that numerous modifications of the present invention may be made without departing from the spirit of the invention which shall be limited only by the scope of the claims appended hereto.

What is claimed is:

1. In combination, a first printed wiring board and a second printed wiring board, each printed wiring board including a plurality of terminals, and a low insertion force arrangement for establishing a connection between said first and second printed wiring boards, said arrangement comprising:

a plurality of connection springs, each spring including first and second contacts, first and second pivot points and an actuator engaging area, each of said contacts engageably positioned relative to a corresponding one of said terminals;

first and second fulcrums positioned to engage each of said springs at said first and second pivot points;

an actuator located proximate to each of said springs at said actuator engaging area, said actuator being positioned in a first actuator position relative to each of said springs to pivot each of said springs about said fulcrums, at said pivot points, to a first spring position and thereby cause said contacts to engage with said respective terminals and said actuator further being positioned in a second actuator position relative to each of said springs to pivot each of said springs about said fulcrums at said pivot points, to a second spring position and thereby cause contacts to disengage from said respective terminals;

a connector body including plurality of spring receiving cavities and at least two printed wiring board receiving cavities; said connection springs each being positioned within a respective one of said spring receiving cavities, said printed wiring boards being positioned within a respective one of said printed wiring board receiving cavities, and said printed wiring board receiving cavities being positioned at an angle to each other.

2. An arrangement as claimed in claim 1, wherein: said terminals are formed on one side of each of said printed wiring boards.

3. An arrangement as claimed in claim 1, wherein said printed wiring board terminals are formed on both sides of each of said printed wiring boards.

4. An arrangement as claimed in claim 1, wherein: selected ones of said printed wiring board terminals are interconnected.

5. An arrangement as claimed in claim 1, wherein: said actuator includes means to simultaneously pivot said connection springs.

6. An arrangement as claimed in claim 1, wherein: said actuator includes means to sequentially pivot said connection springs.

7. An arrangement as claimed in claim 1, wherein: said arrangement includes at least three printed wiring boards, at least one of said printed wiring boards including at least one surface facing an adjacent other one of said printed wiring boards and said other printed wiring board including at least one surface facing said one printed wiring board, both said facing surfaces including corresponding terminals formed thereon and said connection springs connect said corresponding terminals on surfaces of adjacent printed wiring boards facing each other.

* * * * *